United States Patent [19]

Dickson et al.

[11] Patent Number: 4,919,842

[45] Date of Patent: Apr. 24, 1990

[54] CHEMICAL FOR BLEACHING TEXTILES

[76] Inventors: Glen A. Dickson; Donnie R. Gray, both of P.O. Box 18006, Dilley, Tex. 78017

[21] Appl. No.: 269,890

[22] Filed: Feb. 1, 1989

Related U.S. Application Data

[62] Division of Ser. No. 117,664, Nov. 5, 1987.

[51] Int. Cl.[5] ..... D06L 3/00

[52] U.S. Cl. ..... 252/186.43; 252/186.1; 252/186.33; 252/186.27; 252/187.23; 252/187.26

[58] Field of Search ..... 252/186.33, 186.43, 252/187.23, 187.26

[56] References Cited

U.S. PATENT DOCUMENTS

| | | | |
|---|---|---|---|
| 2,657,182 | 10/1953 | Katz | 252/186.33 |
| 3,048,546 | 8/1962 | Lake et al. | 252/95 |
| 3,535,262 | 10/1970 | Hubbuch | 252/186.33 |
| 4,070,300 | 1/1978 | Moroni et al. | 252/190 |
| 4,130,392 | 12/1978 | Diehl et al. | 8/101 |
| 4,536,182 | 8/1985 | Tatin | 8/107 |
| 4,575,887 | 3/1986 | Viramontes | 8/158 |
| 4,601,845 | 7/1986 | Namnath | 252/99 |
| 4,655,953 | 4/1987 | Oakes | 252/99 |
| 4,740,213 | 4/1986 | Ricci | 8/106.1 |

OTHER PUBLICATIONS

American International Chemical, Inc. publication, "Potassium Permanganate Technical-Free Flowing".
Material Safety Data Sheet by GAF Corporation, for Igepal CO-630 Surfactant.
Information circular "Hi-Sil ABS, Carrier for Rubber Chemicals", by PPG Industries, Inc.
"Nature and Safe Handling of Diatomaceous Earth", by Dicalite Division of Grefco, Inc.
Brochure from PPG Industries, Inc. entitled "Hi-Sil, Silene, and Lovel silica products."
Information sheet entitled "Dicalite Diatomite Filteraid Data General Characteristics", from Grefco, Inc.
Pamphlet entitled "Dicalite Filtration Bulletin B-16", by Grefco, Inc.
Chem. Ab. 98(23):196724.
Chem. Ab. 107(7):54203.
Chem. Ab. 107(2):12191.
Chem. Ab. 100(10):73357.

*Primary Examiner*—Stephen J. Lechert, Jr.
*Assistant Examiner*—Virginia B. Caress
*Attorney, Agent, or Firm*—Gunn, Lee & Miller

[57] ABSTRACT

A bleaching composition comprising a partially saturated carrier and a bleaching agent prepared by first mixing the dry carrier with the dry bleaching agent and then adding water while continuing mixing to produce a moist powder. This powder is used in a tumbler with at least partially non-synthetic dyed fabrics to dry bleach or fade the dye from the fabrics. Specifically, the bleaching composition is a mix of potassium permanganate as the bleaching agent and diatomaceous earth as the carrier and is tumbled with the fabric to remove the dye from the fabric. The tumbling causes repeated contact with the bleaching agent and removes the dye in the fabric.

6 Claims, 2 Drawing Sheets

N.G. FEED
100
102
154
156
HIGH TEMPERATURE SHIFT CONVERTER
158
160
162
164
166
168
170
PSA 172
PURGE GAS
174
176
H2 PRODUCT
104
HYDROGENATOR
152
150
ENHANCED HEAT TRANSFER REFORMER
148
RESULFERIZERS
108
106
110
120
114
112
116
118
SATURATOR
123
MAKE-UP PROCESS STEAM
122
CONVENTIONAL REFORMER
126
128
COMBUSTION AIR PREHEAT
PSA PURGE
N.G.
144
146
140
142
124
138
136
132
130
134
178
182
180

CHEMICAL FOR BLEACHING TEXTILES

FIELD OF THE INVENTION

This invention relates to a powdered bleaching composition for fading an at least partially non-synthetic fabric and a method for preparation of the same, as well as a method for using a powdered bleaching composition, nonaqueously to produce a faded look to a garment. More particularly, the bleaching composition contains an at least partially water-saturated carrier activated with a bleaching agent wherein the composition is prepared as a powder by first combining the carrier and bleaching agent, followed by partially saturating the carrier with water. The composition is tumbled with the fabric to be faded, rather than being dissolved in an aqueous bath as is customary.

BACKGROUND OF THE INVENTION

Potassium permanganate ($KMnO_4$), the preferred active bleaching ingredient in the bleaching composition, is an odorless, dark purple salt, forming crystals or granules with a blue metallic luster and a sweetish, astringent taste. It is soluble in water, decomposed by alcohol, acids and many organic solvents and reducing agents. It is used in water treatment, waste treatment, air pollution treatment, in the metal plating industry, and in processing food. In the textile industry it is used to prevent wool felting and to improve the wool's luster, strength and level dyeing characteristics, and as an oxidizing agent to bleach cotton, rayon, and jute.

Diatomaceous earth, the preferred carrier for the bleaching composition, is a non-metallic, at least partially amorphous mineral composed of the skeletal remains of microscopic single-cell aquatic plants called diatoms. Their skeletal framework is primarily silica ($SiO_2$). Diatomaceous earth is highly absorbent and is used in a number of different products ranging from cosmetics to pool filters. Diatomaceous earth comes in three forms: natural product, non-flux (straight) calcined product, and flux-calcined product. During flux-calcination, the individual diatom particles become white in color and fuse together - considerably increasing the particle size. Some of the amorphous silica is converted to crystalling silica (cristobalite) during this process.

Diatomaceous earth is used as a filter aid, mineral filler, and aggregate. As a filter aid, diatomaceous earth is added to a liquid for the purpose of removing suspending solids at commercially required flow rates and produce brilliant clarity. Typical uses include filtration of sugar juices, edible oils and fats, other foods and beverages, beer and wines, swimming pool water, waste water, and industrial chemicals. The unique physical properties of diatomaceous earth make it an excellent mineral filler and formulation agent. Typical uses are: filler in paints, rubber, plastics, paper, cardboard, insulation, concrete and asphalt; coating agent in fertilizer; carrier for catalysts, herbicides, pesticides and fungicides; and as an active ingredient in polishes and cleansers. Diatomaceous earth aggregates are used as industrial absorbents, catalysts supports and carriers for herbicides, pesticides and fungicides. Another type of carrier is Hi-Sil ABS, a synthetic silicon dioxide used with solid chemicals as a filter aid, suspension aid and anti-caking agent. (Hi-Sil is the registered trademark of PPG Industries, Inc., Pittsburgh, Pa.)

Surfactants such as ethylene oxide are known in the art as wetting agents. For example, surfactants are often found in detergents.

The present non-aqueous method for bleaching at least partially non-synthetic textiles, such as cotton denim, to produce a faded or frosted look, uses a bleaching solution made up of an active agent such as a 1–10% solution or potassium permanganate or up to 14% sodium hypochlorite soaked in volcanic rock or pumice. The volcanic rocks are about 2" in diameter, which reduce in diameter when used to about ½". Before the fabric is placed into the tumbler, it must be prewashed to remove the starch and excess dye and then dried or left damp. However, while the damp garment produces a desirous look or effect, 10–20% "seconds" result when the bleach-activated rocks "burn" holes in the damp fabric. The bleach-activated rocks are put into a tumbler with the garments and tumbled for 15–60 minutes, depending upon the look required.

This method is expensive because the rocks get ground up as they collide with each other, the tumbler, and the fabric. Test results show that this method reduces the tensile strength of the denim when compared to the dry method of bleaching using the powdered composition disclosed herein. Furthermore, expensive stainless steel cylinders are required to withstand the pounding. As many as 10–15% of the garments treated are rejected as seconds due, in part, to "hot spots" or large, white, bleached-out spots where the denim doesn't look uniform. This occurs when an individual rock gets jammed up against a fabric and is not allowed to circulate but it contacts with the piece of fabric for a period of time. As a result that fabric gets "burned" and has a much more faded or whitish look than the surrounding fabric. In addition, inconsistent results occur when comparing one batch of cloth from one machine to a second batch for the same machine. This inconsistency results in the inability to predict just how much of the bleaching agent each rock will take up. The weight of the rocks can overload the machines, which typically only take 275 lbs. total load to treat 25–30 garments (about 1½ lbs. of activated rock per pound of garment). Further, the abrasion of the volcanic rocks reduce the useful life or the stainless steel.

U.S. Pat. No. 3,048,546 (Lake, 1962) reveals a bleaching compound which is a solid composition of monopersulfate with a chloride salt used to increase the bleaching and cleansing actions of the monopersulfate (the active ingredient). It also discloses an "abrasive filler" of ground quartz flour, sodium tripolyphosphate, detergent and a perfume. The monopersulfate is used as the active ingredient in a bleaching compound, a bleaching and scouring composition, and a cleanser for hard-to-remove stains from porcelain sinks and bowls. The method for using the composition for bleaching is any desired manner which will maintain contact of the fabric with the treating solution for a time sufficient to cause effective bleaching. The solid compositions can be used to bleach stains from any natural or synthetic textile, but specific examples are given for nylons and other synthetics. The composition dissolves in the liquid, and the use of a carrier is not disclosed.

U.S. Pat. No. 4,655,953 (Oakes, 1987) discloses a detergent bleach made up of peroxide, a manganese, and a sodium salt having a specified pH range. The composition is prepared to launder and bleach stained or soiled fabrics in a liquid at relatively low temperatures. Oakes' invention combines peroxide bleach and manganese, rendering the bleach effective for bleaching at lower temperatures if the pH range is proper.

U.S. Pat. No. 4,130,392 (Diehl et al, 1978) discloses a "dry bleaching" method for bleaching (without use of an aqueous bath) in which damp fabrics are placed in a dryer with a dry, activated bleaching composition. The method discloses a solid peroxygen bleach activated by certain additives and employed in an automatic dryer to remove stain under heat. The Diehl patent presents a method for removing stains from fabric using an automatic dryer and comingling pieces of damp fabric by tumbling under heat, together with an effective amount of a particular bleaching composition, preferably contained in a porous, polyurethane pouch. The solid peroxygen bleaches are preferred over the chlorine bleaches, and the peroxygen bleaches are much less likely to damage fabric dyes. Diehl also discloses a water-soluble silicate material recognized in the art as a "corrosion inhibitor" and employed at about 5% by weight level, but not as a carrier. The preferred method of bleaching uses damp fabrics tumbled for 10–60 minutes at a temperature from 50° C. to about 80° C. The present method uses a different composition and a carrier partially saturated.

SUMMARY OF THE INVENTION

It is the purpose of this invention to overcome the problems that arise during the non-aqueous bath bleaching ("dry bleaching") of an at least partially non-synthetic fabric. Briefly stated, it is the purpose of this invention to provide a powdered bleaching composition which will uniformly and consistently fade the fabric.

It is the further object of this invention to provide for a powdered bleaching composition comprised of a bleaching agent mixed with an inert carrier.

It is a further object of this invention to provide a method for using a powdered bleaching composition to fade a garment by tumbling the garment with the composition, without the wear or tear on the tumbler and fabric heretofore associated with the present methods of dry bleaching fabric.

It is a further object of this invention to set forth a method of preparing a bleaching composition in a manner which maximizes the consistency of the faded garments.

Briefly stated, it is the object of this invention to provide a partially water-saturated carrier and a bleaching agent mix for use in a tumbler with an at least partially non-synthetic dyed fabric, to produce uniform and consistent fade Other advantages of this invention are set below as part of the specifications, or are apparent therefrom.

BRIEF DESCRIPTION OF THE PHOTOGRAPHS

Figure 2:
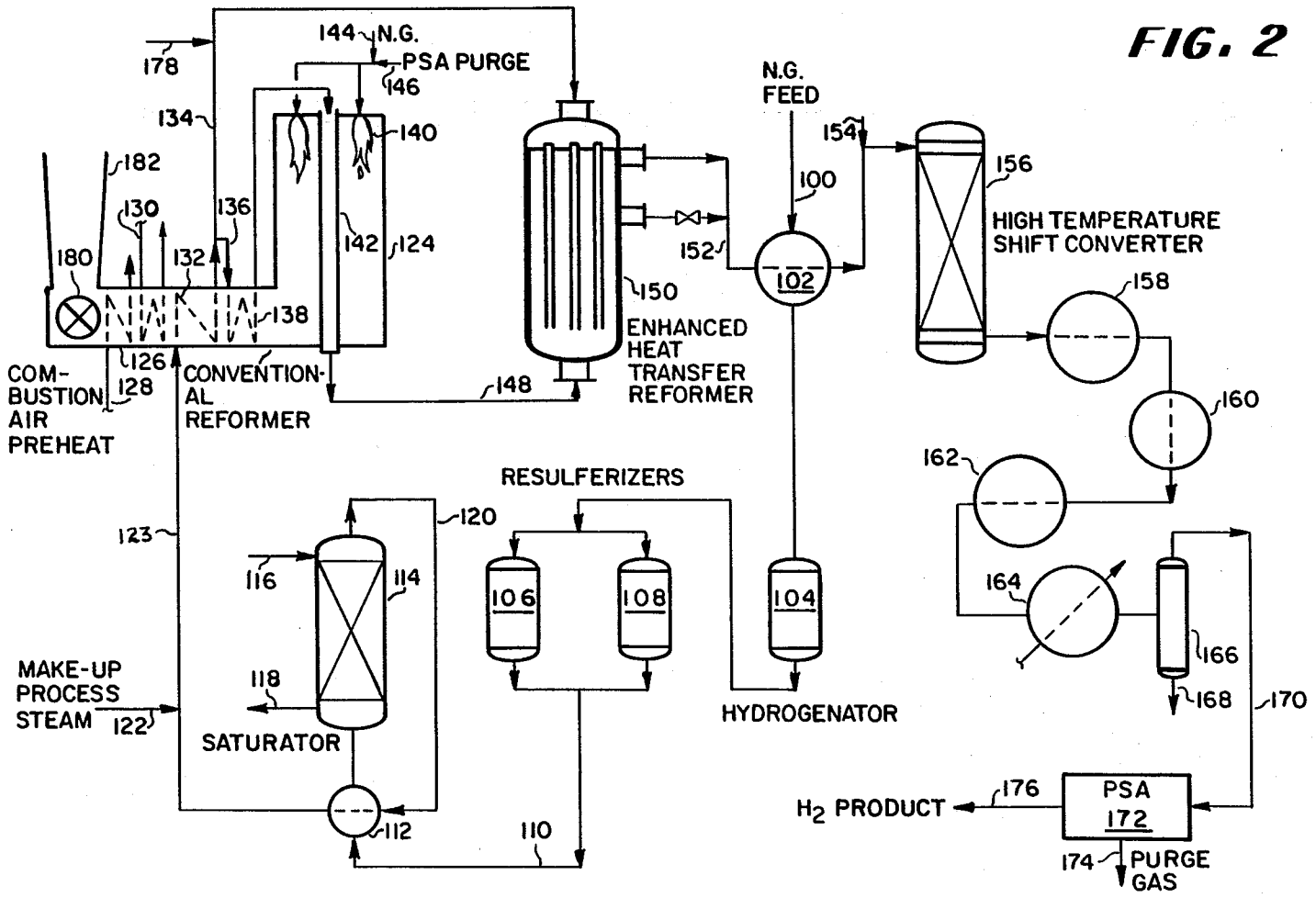
FIG. 2 illustrates the "ice look" produced by dry bleaching a blue denim garment with the powdered bleaching composition.
Figure 1:
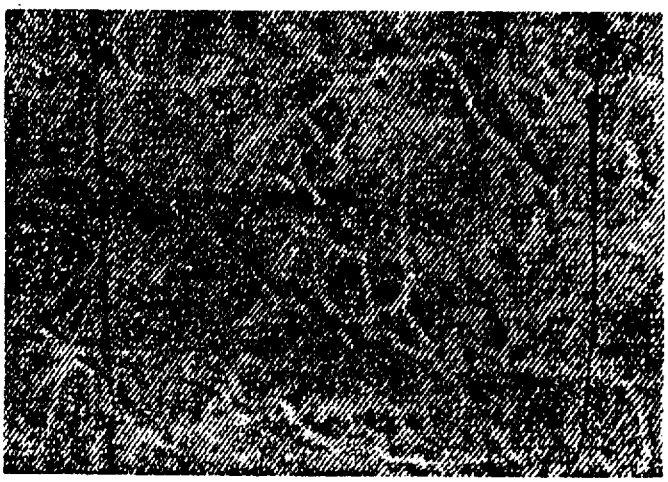
Figure 2:
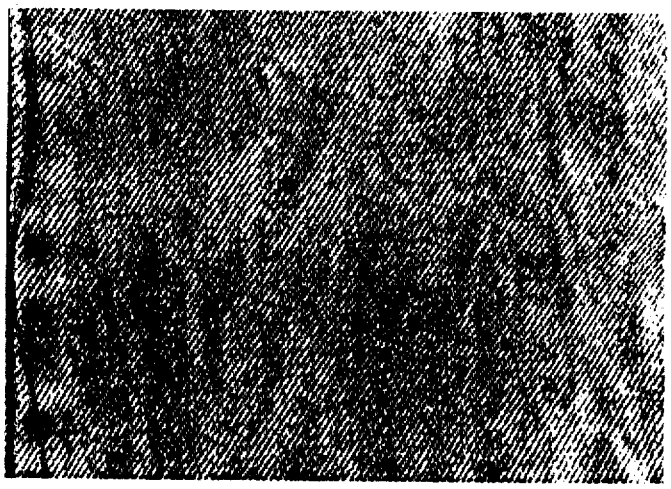
Figure 2A:
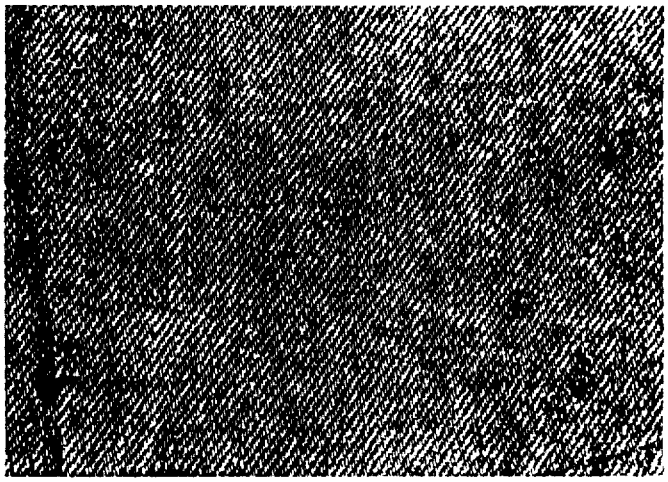

FIG. 2*a* illustrates the "ice look" produced by dry bleaching a black denim garment with the powdered bleaching composition.

Figure 3:
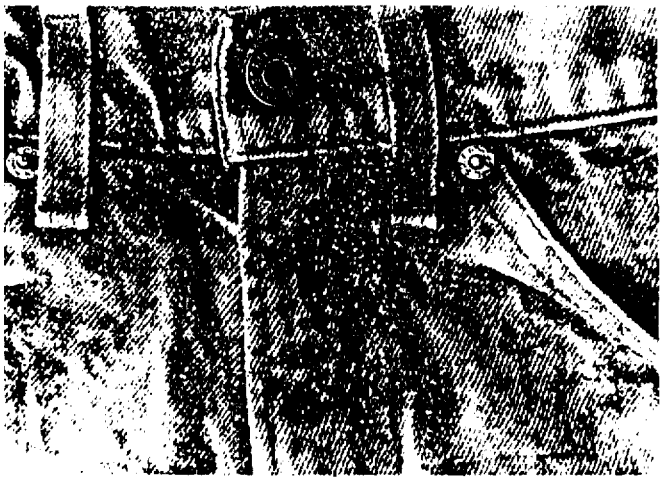

FIG. 3 illustrates the "black sky look" produced by dry bleaching a black denim garment with the powdered bleaching composition.

Figure 4:
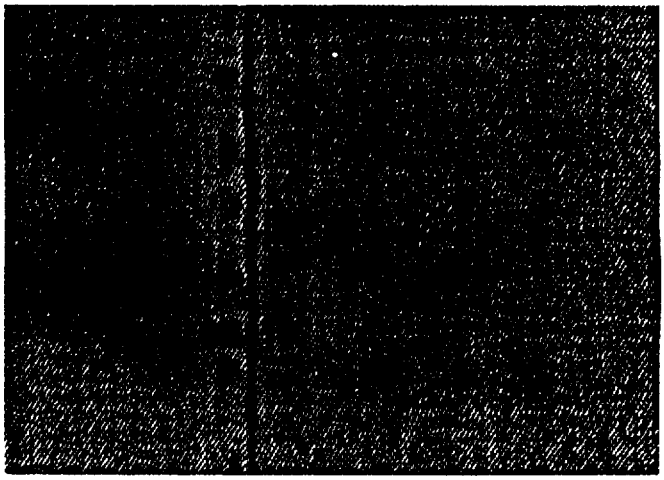

FIG. 4 illustrates the "bright white effect" produced by dry bleaching a black denim garment with the powdered bleaching composition.

Figure 5:
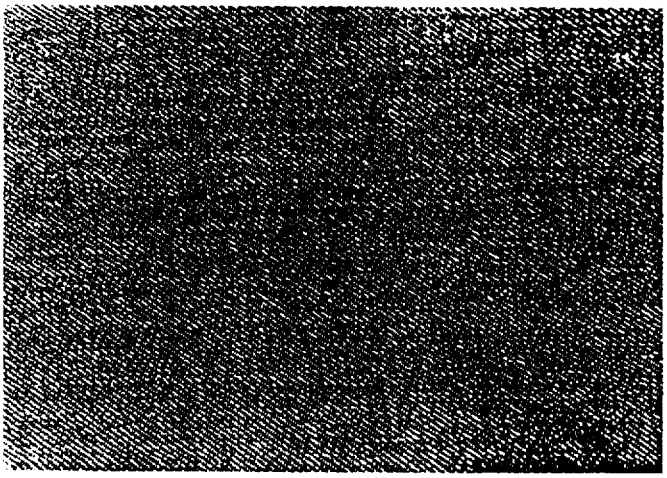

FIG. 5 illustrates unbleached new blue denim and is included for comparison.

DESCRIPTION OF THE PREFERRED EMBODIMENT

The powdered compositions and methods herein described are used for fading, bleaching or removal of dye from an at least partially non-synthetic fabric to change its color and/or appearance by "dry bleaching."

Figure 1:
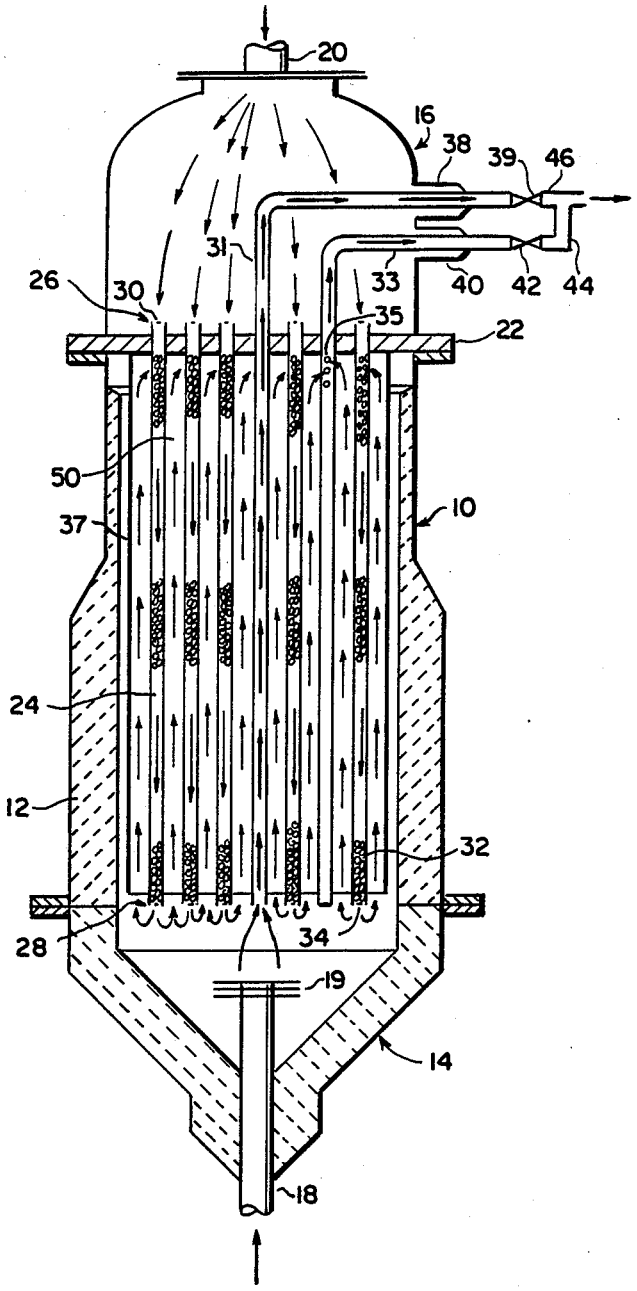
FIG. 1 illustrates the "cracked look" produced by dry bleaching a blue denim garment with the powdered bleaching composition.

The garment is usually treated by the manufacturer before sale to the public. A number of different effects may be achieved such as: "frost" look (for corduroy), "cracked" look—FIG. 1, "ice" look (few or no "cracks" with very low contrast between cracks and background)—FIG. 2 and FIG. 2*a*, black sky effect ("ice" look on black dyed fabric)—FIG. 3, or "bright white" effect (uniform white background also called a "super ice" look)—FIG. 4. Each look differs from the others in the extent of fade, the uniformity of fade and the presence or absence of "cracks" (web-like, lighter colored streaks), and in the amount of contrast between the color of the cracks and the background color. They all differ from the undyed fabric—FIG. 5 (blue denim), which is included for comparison.

This description will be segregated into three parts: the make up of a bleaching composition, the manner in which a bleaching composition is made, and a method for using a bleaching composition to fade or bleach a fabric.

The preferred active bleaching ingredient in the composition is potassium permanganate ($KMnO_4$). This chemical is known in the art as a strong oxidizing agent and is useful to bleach fabrics. The potassium permanganate is carried in a partially water-saturated powdered diatomaceous earth or other suitable powdered carrier. In some embodiments of the composition, "preactivated" diatomaceous earth, which has been prepared by mixing diatomaceous earth with potassium permanganate and subsequently partially saturating the diatomaceous earth with water (in a manner set forth more fully below), is with a non-preactivated carrier, preferably diatomaceous earth. The non-preactivated diatomaceous earth is partially water-saturated but without the bleaching agent (preferably potassium permanganate) being added.

The compositions follow as examples A–D represent different bleaching strengths and are used (in a manner more fully set forth below) to achieve different effects or looks with a fabric.

Example A is a bleaching composition blend that contains only a "preactivated" diatomaceous earth. The term "preactivated" means a carrier that is physically combined with the bleaching agent before it is mixed with anything else. Other blends contain a nonpreactivated portion wherein that nonpreactivated portion is separately prepared before mixing with an activated portion.

EXAMPLE A

Diatomaceous earth (DE)—50% by weight
Potassium Permanganate—4% by weight
Water—46% by weight The preferred method of preparing Example A is as follows: first, substantially dry diatomaceous earth is placed into a blender or mixer, preferably a ribbon blender such as a Hayes & Stoltz blender (Ft. Wayne, Ind.) capable of mixing up to 7,000 pounds in its 215 cubic foot cavity, or other blenders known in the art. The blender is then energized and potassium permanganate, preferably free flowing grade, (technical or industrial standard is sufficient) is slowly added. The potassium permanganate is added to the diatomaceous earth at the rate of approximately five pounds per minute in an even distribution, and mixing continues even after all potassium permanganate is added until a uniform mix is reached (approximately ten minutes in a 7,000 lb. mix). Following the dry blending of the diatomaceous earth and the potassium permanganate, water (preferably deionized) is slowly added. The preferred rate of flow is approximately 4.5 gallons per minute, as measured by a flow meter. The blender operates continuously at approximately 450 revolutions per minute, during the addition of the water. The water should be added by uniformly spraying the mix, rather than adding in bulk flow through a single outlet. By spraying, the water uniformly "wets" each diatomaceous earth grain with the potassium permanganate. After all the water has been added, mixing continues for approximately twenty minutes, until a uniformly moist, fluffy purple powder results.

While the preferred method for preparing the composition is set forth, an alternate method would be to first prepare a solution of bleaching agent, then thoroughly mixing the solution with a carrier to form an activated powder bleaching composition. The composition as represented by Example A could be made by first preparing a solution of potassium permanganate and water then adding it to the carrier (preferably by spraying) while mixing the carrier. Test results indicate that a look different from those set forth in FIGS. 1-5 is achieved when this alternate process is followed.

Example A is the strongest bleaching composition and results in the greatest amount of fading to a garment, under otherwise identical conditions. While 4% is disclosed as the percent of bleaching agent in Example A, the bleaching agent may range from ½% to 20% of the total weight of the composition. The liquid (water in Example A) is in the range of 5% to 70% of the total weight and the carrier 10% to 94½%.

The diatomaceous earth is available from a number of chemical supply outlets such as Eagle-Picher Minerals, Inc. of Reno, Nev., which markets the substance under the mark "Celatom." The preferred embodiment uses diatomaceous earth (flux-calcined) of grade 4200, a relative flow rate of 1800, with a loose weight of 16.0 lbs./ft.$^3$, a pH of 10, 2.35 specific gravity, and 12% retention on U.S. Std. Sieve No. 140. This diatomaceous earth is primarily amorphous so it can absorb liquids with varying percentages of chrystalline silica.

In addition to the ingredients set forth in Example A, and, in fact, for any of the examples stated herein, a nonionic surfactant may be added as a wetting agent to break down the surface tension on the water. A suitable nonionic surfactant is ethylene oxide $(C_2H_4O)_nC_{15}H_{24}O$, n=9. There are other types of active bleaching agents that may be substituted for potassium permanganate; for example: sodium hypochlorite, sodium chlorite, potassium persulfate, sodium persulfate, ammonium persulfate, or sodium hyposulfite. Potassium permanganate is especially suitable as a bleaching agent because it reacts with the dyes most frequently used with denim. That is, the preferred bleaching agents are those that react with the dye of the garment. Most bleaching chemicals are specifically formulated to react with stains and do not affect the dye of the fabric, or to do so only minimally. For this reason, potassium permanganate and other dye reactive oxidizers are more effective to produce the desired faded look to the garment.

Carriers other than diatomaceous earth may be used, such as: feldspar, soda ash, sodium silica, synthetic silica dioxides, lime (calcium carbonate), sodium bicarbonate, sodium sesquacarbonate, borax, and sodium sulfate.

It is the purpose of the carrier to remain inert, yet at least partially absorb the bleaching agent, and to adhere well to the garment. When the carrier contacts the fabric, the bleaching agent reacts therewith to produce the desired results. The diatomaceous earth is made up of millions of microscopic particles and when thoroughly blended with the potassium permanganate is capable of creating millions of microscopic bleached or faded spots on the garment. However, mixing a solution of potassium permanganate and then mixing with diatomaceous earth does not readily produce the preferred look (FIGS. 1-4) on the fabric. Rather, the thorough blending of the diatomaceous earth and potassium permanganate prior to the addition of water by spraying onto those two ingredients as they are mixing produces more pleasing results.

A second powdered bleaching composition, Example B, contains the following:

EXAMPLE B

Diatomaceous earth (DE)—50% by weight
Potassium Permanganate—3% by weight
Water—47% by weight The method for preparing the composite represented by Example B is substantially the same as set forth for Example A above.

Example B is a preactivated composition of diatomaceous earth which produces, under similar conditions, a lesser degree of fade than that produced by Example A. Both Example A and Example B are examples of the bleaching composition made up only of preactivated carrier.

The method of preparing a two part (preactivated and non-preactivated) blend of the powdered bleaching composition is to mix the two parts separately, then combine them to form the bleaching composition. The preactivated portion will be the stronger bleaching agent of the two parts. The non-preactivated part will be a weaker bleaching agent, having only the bleaching agent it picks up when being combined with the preactivated portion. While the two parts may be combined in any ratio, it is preferable to have the preactivated part comprising at least 30% to 70% of the bleaching composition. The non-preactivated portion of the two part bleaching composition preferably contains a carrier partially saturated with substantially water. The preferred percentage of water in the non-preactivated part is in the range of 20%-70% of the total weight of the non-preactivated part.

Example C illustrates a two-part blend: C′ which contains only preactivated carrier and C″ which contains only non-preactivated carrier. C′ and C″ are blended separately, then combined to form C. The preferred composition of each is as follows:

EXAMPLE C'

(61.6% weight of C)

Diatomaceous earth (DE)—30% of the total volume weight in Example C
Potassium Permanganate—4%
Water—27.6% of the total volume weight in Example C

EXAMPLE C''

(38.4% weight of C)

Diatomaceous earth (DE)—20% of the total volume weight of Example C
Water—18.4% of the total volume weight of water in Example C Example C' is the preactivated portion of Example C and is prepared separately from C'' following the directions set forth for Example A above. C'' is prepared by mixing diatomaceous earth with water sprayed uniformly into the blender; mixed to a moist, uniform fluffiness. The water should be added at about the same rate water was added to prepare Example A.

Example C is prepared by mixing C' and C'' together. For example, if 1,000 pounds of Example C is desired, preparation will proceed as follows. C' would be mixed using 300 pounds of diatomaceous earth, 40 pounds of potassium permanganate, and 276 pounds of water. C' would be mixed according to directions set forth for Example A above to produce a fluffy, purple powder. This is the portion of Example C which is "preactivated." C'' would then be prepared using 200 pounds of diatomaceous earth, and 184 pounds of water. This would result in 384 pounds of non-preactivated diatomaceous earth. The 616 pounds of C' and the 384 pounds of C'' are then mixed in a blender for about 5–10 minutes to produce 1,000 pounds of bleaching composition.

The preactivated (C') portion of Example C contains diatomaceous earth into which potassium permanganate, at least in part, has been absorbed. During the blending of C' and C'', some of the potassium permanganate on the surface of the preactivated diatomaceous earth particles coats the surface of the non-preactivated (C'') particles of the composition. Example C produces a "medium fade" look with less fade than that produced by Example A or B.

Example D is yet another example of a composition produced by the blend of a non-preactivated carrier with a preactivated carrier. Example D is prepared in precisely the same way as Example C above, but uses 2% potassium permanganate and 48% water in the preactivated portion (corresponding to C').

Safely handling the compositions described above requires adherence to the following guidelines: do not get in eyes, on skin, on clothing; do not take internally; use with adequate ventilation and employ respiratory protection; when handling, wear chemical splash goggles, face shield, rubber gloves, and protective clothing; wash thoroughly after handling or contact; keep container closed; and keep away from acids (to avoid possible violent reaction).

In general, a preferred method of using a composition is to insert the garments into a tumbler with the bleaching agent and tumble for a period of time. The tumbling causes repeated contact between the composition and the garments, thereby bleaching the dye out of the fabric.

There are a number of factors, the variation of which alter the degree of fade in a tumbled fabric. These factors include: the strength of the composition, the moisture content of the fabric, the length of time that the garment is tumbled the amount of bleaching composition used, and the pH of the fabric.

If a fabric has a high or a low pH, it may inhibit the action of the bleaching agent used and may have to be neutralized in the prerinse before tumbling. The pH of most denim does not inhibit the bleaching action of potassium permanganate.

Probably the most frequent fabric which is the subject of bleaching is the blue cotton denim, which is often prefaded by the manufacturer or contractor before it is sold to the public. This "faded" look is at present enjoying much popularity. Therefore, this discussion which sets forth a method of use of a bleaching composition is directed to such fabric.

Denim is usually prewashed in a soap or detergent to remove starch and other substances. Following the prewash, the wet garment is prerinsed in water and spun (extracted) for a period of time. This spinning extracts the rinse water from the garment. However, for certain faded looks the garment is removed from the rinse dripping wet (without any extraction), and directly inserted into the tumbler with the bleaching composition. When the tumbling begins with a saturated (non-extracted) garment, more bleaching results (and the garment has a more faded appearance) because the water on the garment activates the composition. The extraction of water prior to placing the fabric in the tumbler decreases the amount or bleaching, if all other variables are kept constant. For example, differences in the garment's appearance can be discerned between dripping wet (most faded) and a ten-minute extraction, and at one-minute intervals therebetween. Preferably, a two to ten minute extraction is used for a typical heavy weight (24 oz.) blue denim, to produce a uniform ice look.

For decreasing the "cracks" in the garment, a period or drying may be introduced following the extraction step. This will remove even more water than the extraction step.

It is helpful to shake out and lay flat or drape the garments following prerinse. This allows folds or creases to unfold (or uncrease) before tumbling. Sometimes a folded garment will not unfold during tumbling, and the portion covered by the fold or crease will not receive enough bleaching.

The bleaching ability of the compositions is determined, in part, by their potassium permanganate content. The strongest mixture is illustrated in Example A above, and is used to produce a "bright white" look on blue denim with "cracks" or streaks of blue. Example B produces a more "medium white" look on denim articles. Example C produces a blue/white medium fade background with low contrast between the streaks and the background. This mix is appropriate for denim jeans, skirts, handbags, corduroys, sweat shirts, and the like. Example D, on the other hand, is best suited for a lighter weight denim (thin shirts, 12–18 oz garments), and it produces a medium blue-white faded look.

Depending on the size and weight of the garments, 3/16 of a pound to one pound of composition is placed in the tumbler for each garment. For example, a medium weight garment such as a 16–18 oz. shirt, when tumbled with 3/16 of a pound of composition A gives just a medium blue-white faded look to the fabric. However, the same fabric tumbled with one pound of composition per garment produces a more white look.

Garments are tumbled at ambient temperature for two to ten minutes, again depending upon the extent of "fade" desired. The longer the tumbling period, the greater the fade—to a point. Test results indicate that almost all combinations produce their maximum effect within 10 minutes, regardless of the extraction of the garment.

An example of how time of tumbling and number of garments can affect consistency is illustrated by the following trial. Ten jeans were placed in a 275 lb. commercial washer for tumbling with ¼ lb. of composition per garment. A three-minute tumble produced consistency in fade from jean to jean within that group. Next, 25 jeans were run under the same conditions, and the consistency held. However, when 50 jeans were used, five minutes of tumbling was required to achieve that same degree of consistency. In fact, the trial indicated that up to 115 jeans could be tumbled for five minutes with satisfactory consistency.

Examples of how each of the variables (garments size and weight, amount of composition, strength of composition, amount of extraction, and time of tumbling and pH of the garment) interact is illustrated by the following test results.

Test I was run on 24 oz., prewashed and rinsed Wrangler jeans. Composition A was used with a thirty second extraction at a ratio of ¼ of a pound of composition per garment. The garments were tumbled at room temperature for four minutes. The result was a medium blue-white faded look, in the order of magnitude of 7–8 (0=unfaded, 10=total bleach out), with some cracks, and strong contrast between background and cracks. More testing on the same weight garment indicated that less than thirty seconds of extraction or more than two minutes or extraction tended to eliminate the cracks.

Test II was run under the same conditions on the same garment but using an Example D composition and resulted in a more "cracked" look, with more blue and less fade in the order of magnitude 3–4.

Test III was performed on a fabric made up of predominately cotton blend but in a corduroy texture. Under the same conditions as the second test set forth above, "frosted" look was achieved, without a "cracked" effect. This results because of the peak and valley cross-section of a corduroy fabric. The peaks tend to be most bleached, and the valleys least bleached.

Test IV used Blend D with a dark blue sweat shirt (medium weight garment) that was damp (approximately three-minute extraction) and tumbled for approximately seven minutes. This produced a very light blue (approximately a magnitude of 3–4) very uniform and very consistent look, with cracks.

Of course, the desired results are produced by experimenting with the variable set forth above. Different fabric manufacturers use different strength dyes on different weight fabrics. Even the same manufacturer's fabrics differ from batch to batch. However, test results indicate that the preferred composition when used in the preferred method gives surprisingly uniform results for a given fabric from a given manufacturer, once the "recipe" of extraction, tumbling, and ratio of composition per garment is determined for the desired look.

The tumblers used to produce the stone wash look are designed to carry volcanic rocks with about a 2" length. They are commercial grade and capacity spin washers, such as the Washex, or others known in the art. However, since water is not used during tumbling, that apparatus is usually disconnected. For using the powder composition, however, the cylinder of the tumbler must be further modified to seal up the holes therein; otherwise, the powder composition would escape during the tumbling. Therefore, curved plates or other liners are used, attached to the inside curvature of the carrier, to prevent loss of powder.

Following tumbling, the garments are rinsed to remove the bleaching chemicals and any carrier remaining on the fabric. The rinse is preferably done in a neutralizing solution or antichlor. One such neutralizing solution is prepared by mixing 70% sodium metabisulfite (the active neutralizer) and 30% sodium sulfite anhydrous and works effectively to neutralize potassium permanganate. Following neutralization, the garment is washed and rinsed. These two steps complete the removal of any foreign chemicals from the garment.

Although the invention has been described with reference to a specific embodiment and method, this description is not meant in a limiting sense. Various modifications of the disclosed compositions and methods will become apparent to those skilled in the art upon reference to these specifications. It is, therefore, contemplated that the appended claims will cover such modifications that fall within the scope of the invention.

I claim:

1. A method for preparing a powdered bleaching composition for fading a dyed denim fabric comprising the steps of:

first mixing a first batch by combining a first diatomaceous earth powder carrier and a dry potassium permanganate bleaching agent;

second mixing of the first batch with a liquid, wherein the liquid is water, the liquid of said second mixing being added in an amount not greater than the maximum amount that can be added while still maintaining a powder consistency to the first batch; and third mixing the first batch after all the liquid has been added, said third mixing continued until the liquid is uniformly distributed throughout the first batch.

2. A powdered bleaching composition prepared by the method as set forth in claim 1.

3. A powdered bleaching composition prepared by the method as described in claim 1 wherein said bleaching composition is (by weight):

about 4% dry potassium permanganate;

about 50% dry diatomaceous earth; and about 46% water.

4. The method as described in claim 1 further comprising the steps of:

fourth mixing a second batch by combining a second diatomaceous earth powder carrier and water, adding the water while mixing the second carrier, the water of said fourth mixing being added in an amount not greater than the maximum amount that can be added while still maintaining a powder consistency to the second batch; and fifth mixing the first batch with the second batch, until the batches are combined.

5. A powder bleaching composition prepared by the as set forth in claim 4 wherein:

the bleaching agent of the first batch is 4% potassium permanganate by weight of the first batch; the carrier of the first batch is 50% diatomaceous earth by weight of the first batch, and the water of the first batch is 46% by weight of the first batch; and the carrier of the second batch is 55% by weight of the second batch and the water of the second batch is 45% by weight of the second batch;

wherein 60% of the total weight of the bleaching composition is made up of the first batch and 40% of the total weight of the bleaching composition is made up of the second batch.

6. A composition for dry bleaching a dye out of denim fabric to produce a faded look, consisting essentially of:

a diatomaceous earth powder carrier capable of absorbing a liquid;

½–20% potassium permanganate; and water;

wherein said powder carrier, said potassium permanganate, and water are physically mixed to form the composition, said potassium permanganate being ½ to 20% by weight of the composition.

* * * * *

UNITED STATES PATENT AND TRADEMARK OFFICE

CERTIFICATE OF CORRECTION

PATENT NO. : 4,919,842

DATED : April 24, 1990

INVENTOR(S) : Glen A. Dickson, et al

It is certified that error appears in the above-identified patent and that said Letters Patent is hereby corrected as shown below:

The title page showing the illustrative figure should be deleted to appear as per attached title page.

The sheets of drawings should be deleted to be replaced with the (2) sheets of drawings as shown on the attached sheets.

Signed and Sealed this

Twenty-second Day of October, 1991

*Attest:*

HARRY F. MANBECK, JR.

*Attesting Officer*

*Commissioner of Patents and Trademarks*

United States Patent [19]

Dickson et al.

[11] Patent Number: 4,919,842

[45] Date of Patent: Apr. 24, 1990

[54] CHEMICAL FOR BLEACHING TEXTILES

[76] Inventors: Glen A. Dickson; Donnie R. Gray, both of P.O. Box 18006, Dilley, Tex. 78017

[21] Appl. No.: 269,890

[22] Filed: Feb. 1, 1989

Related U.S. Application Data

[62] Division of Ser. No. 117,664, Nov. 5, 1987.

[51] Int. Cl.[5] ..... D06L 3/00

[52] U.S. Cl. ..... 252/186.43; 252/186.1; 252/186.33; 252/186.27; 252/187.23; 252/187.26

[58] Field of Search ..... 252/186.33, 186.43, 252/187.23, 187.26

[56] References Cited

U.S. PATENT DOCUMENTS

| | | | |
|---|---|---|---|
| 2,657,182 | 10/1953 | Katz | 252/186.33 |
| 3,048,546 | 8/1962 | Lake et al. | 252/95 |
| 3,535,262 | 10/1970 | Hubbuch | 252/186.33 |
| 4,070,300 | 1/1978 | Moroni et al. | 252/190 |
| 4,130,392 | 12/1978 | Diehl et al. | 8/101 |
| 4,536,182 | 8/1985 | Tatin | 8/107 |
| 4,575,887 | 3/1986 | Viramontes | 8/158 |
| 4,601,845 | 7/1986 | Namnath | 252/99 |
| 4,655,953 | 4/1987 | Oakes | 252/99 |
| 4,740,213 | 4/1986 | Ricci | 8/106.1 |

OTHER PUBLICATIONS

American International Chemical, Inc. publication, "Potassium Permanganate Technical-Free Flowing".
Material Safety Data Sheet by GAF Corporatjon, for Igepal CO-630 Surfactant.
Information circular "Hi-Sil ABS, Carrier for Rubber Chemicals", by PPG Industries, Inc.
"Nature and Safe Handling of Diatomaceous Earth", by Dicalite Division of Grefco, Inc.
Brochure from PPG Industries, Inc. entitled "Hi-Sil, Silene, and Lovel silica products."
Information sheet entitled "Dicalite Diatomite Filteraid Data General Characteristics", from Grefco, Inc.
Pamphlet entitled "Dicalite Filtration Bulletin B-16", by Grefco, Inc.
Chem. Ab. 98(23):196724.
Chem. Ab. 107(7):54203.
Chem. Ab. 107(2):12191.
Chem. Ab. 100(10):73357.

*Primary Examiner*—Stephen J. Lechert, Jr.
*Assistant Examiner*—Virginia B. Caress
*Attorney, Agent, or Firm*—Gunn, Lee & Miller

[57] ABSTRACT

A bleaching composition comprising a partially saturated carrier and a bleaching agent prepared by first mixing the dry carrier with the dry bleaching agent and then adding water while continuing mixing to produce a moist powder. This powder is used in a tumbler with at least partially non-synthetic dyed fabrics to dry bleach or fade the dye from the fabrics. Specifically, the bleaching composition is a mix of potassium permanganate as the bleaching agent and diatomaceous earth as the carrier and is tumbled with the fabric to remove the dye from the fabric. The tumbling causes repeated contact with the bleaching agent and removes the dye in the fabric.

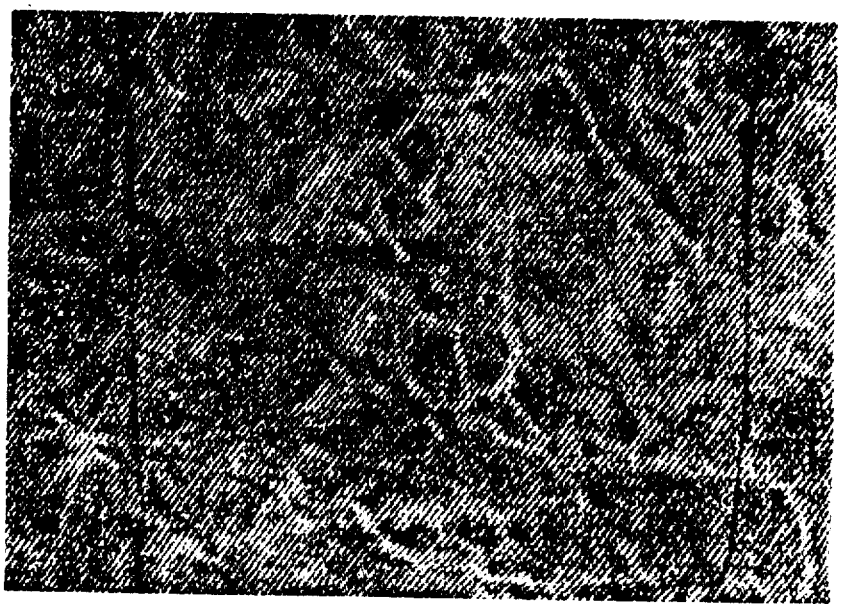

6 Claims, 2 Drawing Sheets